United States Patent [19]

Emmer

[11] 4,352,953

[45] Oct. 5, 1982

[54] MULTICHANNEL NON-DISCRETE AUDIO REPRODUCTION SYSTEM

[76] Inventor: Samuel Emmer, 6365 Stonecress Ave., Newark, Calif. 94560

[21] Appl. No.: 941,151

[22] Filed: Sep. 11, 1978

[51] Int. Cl.[3] ..... H04S 1/00

[52] U.S. Cl. ..... 179/1 G; 179/1 GA

[58] Field of Search ..... 179/1 G, 1 GA, 1 GQ, 179/1 E, 100.45 T; 181/144, 145, 147, 141; 369/86

[56] References Cited

U.S. PATENT DOCUMENTS

| | | | |
|---|---|---|---|
| 3,060,266 | 10/1962 | Dow | 179/1 G |
| 3,171,891 | 3/1965 | Amos et al. | 179/1 G |
| 3,280,258 | 10/1966 | Curtis | 179/1 G |
| 3,342,923 | 9/1967 | Henley | 84/DIG. 27 |
| 3,491,204 | 1/1970 | Sherno | 179/1 G |
| 3,710,023 | 1/1973 | Greuzard et al. | 179/1 G |
| 3,725,586 | 4/1973 | Iida | 179/1 G |
| 3,757,046 | 9/1973 | Williams | 179/1 G |
| 3,772,479 | 11/1973 | Hilbert | 179/1 GQ |
| 3,818,115 | 6/1974 | Hirano | 84/DIG. 27 |
| 3,892,917 | 7/1975 | Sotome | 179/1 GQ |
| 3,971,890 | 7/1976 | Bauer | 179/1 GQ |

FOREIGN PATENT DOCUMENTS

| | | | |
|---|---|---|---|
| 862769 | 1/1953 | Fed. Rep. of Germany | 179/1 G |
| 7509515 | 8/1975 | Netherlands | 179/1 G |

OTHER PUBLICATIONS

Klipsch, "Circuits for Three-Channel Stereophonic Playback . . . ", *IRE Transactions on Audio,* Nov.-Dec. 1959, pp. 161-165.

*Primary Examiner*—Douglas W. Olms

*Attorney, Agent, or Firm*—Fitch, Even, Tabin, Flannery & Welsh

[57] ABSTRACT

A method and apparatus for generating a plurality of audio outputs from first and second stereophonically related audio signals includes coupling the first audio signal out as a leftmost audio output channel, coupling the second signal out as a rightmost audio output channel, and coupling said first and second signals to one or more mixers, each said mixer acting to combine a predetermined portion of said first signal with a predetermined portion of said second signal, and one or more amplifiers, each operatively connected to the output of a respective mixer, for amplifying said combined signal from said prospective mixer such that an intermediate audio output channel is generated by each said amplifier thereby.

9 Claims, 3 Drawing Figures

MULTICHANNEL NON-DISCRETE AUDIO REPRODUCTION SYSTEM

BACKGROUND OF THE INVENTION

A number of systems have been proposed to improve the quality of sound which is heard by a listener. One method that has been used has been to increase the number of discrete channels available for reproduction. In standard stereo systems two or more microphones are used to input the sound to a recording medium, but these inputs are mixed such that only two discrete channels are ultimately recorded. More recent systems have provided for four discrete channels, or quadraphonic sound recording and reproduction. Other systems have provided quasi-discrete means for obtaining more output audio channels from a fixed number of original channels. Such prior art systems have generated imitation four-channel stereo from the two stereo output channels, by means of complex filtering or phase modification of such input signals to generate the pseudo-quadraphonic sound. These prior art systems are also normally designed such that two speakers face the listener, and two additional speakers are positioned behind the listener, to provide a sound which has been termed three-dimensional.

Some prior art systems are known wherein a multiple number of output channels can be derived, and wherein the speakers may all be arranged in front of the listener, but such systems have involved complex methods for controling the gain to enhance stereo separation so that up to two more pseudo-channels can be derived by enhancing stereo separation for spacial expansion. See e.g. U.S. Pat. No. 3,772,479. Another system generates a third channel from stero, but this new channel outputs only monaural sound. See e.g. U.S. Pat. No. 3,491,204.

SUMMARY OF THE INVENTION

The present invention provides an improved means for generating a multiple number of audio output channels from a standard two audio output channel stereo signal with speakers for generation of sounds from each channel arranged in front of a listener. The intermediate audio channels between the left and the right speakers are obtained by mixing a predetermined amplitude portion from each of the left and right stereophonically related audio output signal, with each mixer having high effective impedance such that said audio output signals are not overloaded. The output of each mixer is then amplified such that the sound output from the intermediate channel is of equal relative amplitude to the signals emanating from the left and right speakers.

Therefore, a principal object of the present invention is to provide a multichannel non-discrete audio reproduction system wherein one or more additional output channels are provided in addition to a standard two-channel stereo output, such that the audio void between the left and right speakers is substantially reduced or eliminated, to thereby significantly improve the directional characteristics of the sound reproduced and to thus provide more realism in such sound.

Another object of the present invention is to provide a multichannel non-discrete audio reproduction system wherein the system is simple and easy to install to already existing stereo systems, being fully compatible therewith.

A further object of the present invention is to provide a multichannel non-discrete audio reproduction system wherein any number of intermediate channels can be generated thereby, at the user's option.

A still further object of the present invention is to provide a multichannel non-discrete audio reproduction system wherein an increased number of output audio channels are provided, to thereby enhance the quality of sound produced.

These and other objects and advantages of the present invention will become more clear upon reference to the accompanying drawings and the following description.

DESCRIPTION OF A PREFERRED EMBODIMENT

Figure 1:
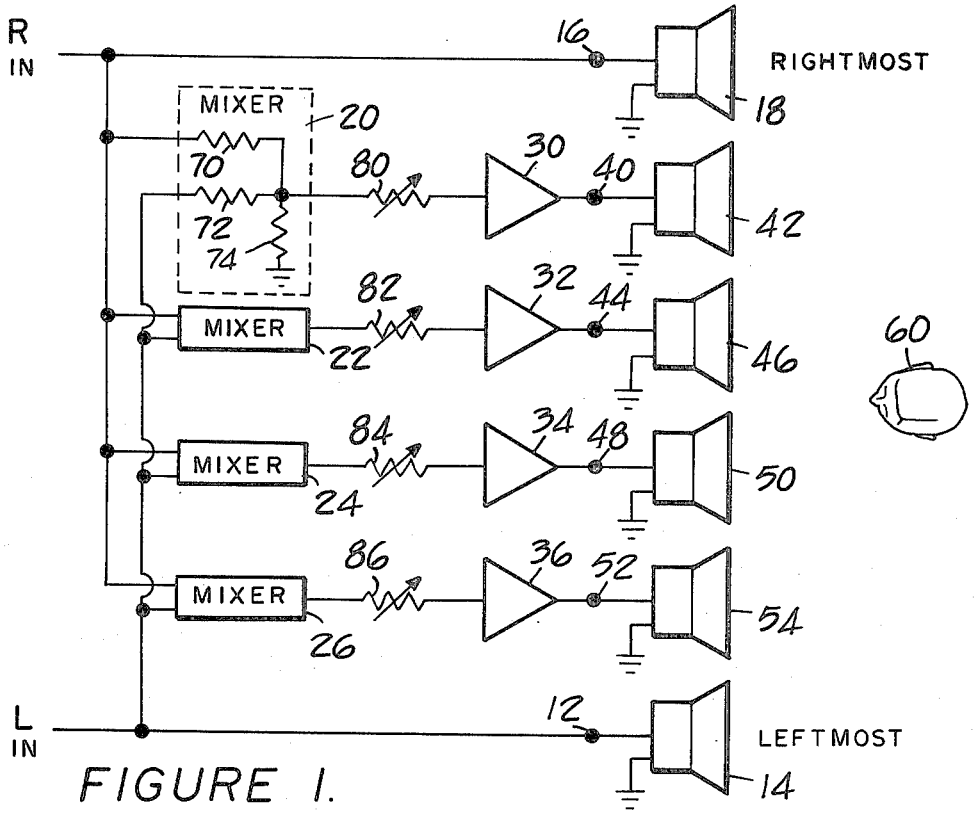
FIG. 1 is an electronic schematic, partially in block diagram form, illustrating the circuit components of one embodiment of the present invention.

FIG. 1 illustrates one embodiment of the present invention illustrating the electronic schematic of a multichannel non-discrete audio reproduction system, wherein four additional intermediate channels are generated in addition to the stereophonically related audio output signals, the left channel signal L and the right channel signal R.

Referring now to FIG. 1, the left channel signal L is coupled out as a leftmost audio output channel 12 to the leftmost speaker 14, and the right channel signal R is coupled out as the rightmost audio output channel 16 to the rightmost speaker 18. Also included are means for mixing a predetermined amplitude portion of the left channel signal, as a first signal, with a predetermined amplitude portion of the right channel signal, as a second signal. This means, as shown in FIG. 1, include a plurality of mixers, shown at 20, 22, 24 and 26. Each said mixer operates to attenuate the audio signal input to it by a predetermined amount, to isolate the first signal from the second signal and to additively combine the attenuated signal from both the originating first signal and originating second signal.

The mixer in the preferred embodiment is designed such that it couples a lesser amplitude portion from the first audio signal to each said intermediate channel as a function of the distance that the corresponding intermediate speaker is away from said leftmost speaker 14 and nearer to said rightmost speaker 18. Each mixer is further defined to couple a lesser amplitude portion from said second audio signal to each intermediate channel as a function of the distance that the corresponding intermediate speaker is away from said rightmost speaker 18 and nearer to said leftmost speaker 14, to the same extent that said amplitude portion from said first signal is lessened in amplitude in the opposite direction from said leftmost speaker 14.

Each mixer may be further defined to attenuate a given first signal for a specific intermediate channel in a fractional amount equal to the number of speakers positioned to the right of said intermediate speaker divided by the total number of speakers in the system less one. Similarly, the mixer is defined to attenuate a given second signal, for the same intermediate channel, in a fractional amount equal to the number of speakers positioned to the left of said intermediate speaker divided by a total number of speakers in the system less one. The output signal transferred to this intermediate channel by said mixer is thereby equal to the sum of these two fractional amounts, or amplitude portions.

The output of each mixer 20, 22, 24 and 26 is coupled to amplifier means comprising respective amplifiers 30, 32, 34 and 36. The signal output of amplifier 30 comprises intermediate channel 40, and is output to speaker 42. Similarly, the signal outputs of amplifiers 32, 34 and 36 are coupled out as intermediate channels 44, 48 and 52 to respective speakers 46, 50 and 54. These amplifiers are designed such that the output of each respective speaker is substantially equal in relative signal strength as the signals output from the leftmost speaker 14 and rightmost speaker 18. Thus, these amplifiers provide means for equalizing the output from each intermediate channel such that the signal output by each speaker in said apparatus will be of the same relative signal strength.

As can be seen in FIG. 1, the position of the plurality of speakers in the reproduction system of the present invention is determined by reference to the listener, shown diagrammatically at 60. In the preferred embodiment, each of the speakers 18, 42, 46, 50 and 54 and 14 are positioned in an ordered series in front of the listener 60, to provide thereby a means for improving the realism of the directionality of the sound generated therefrom.

Thus, in five-speaker system, for example, of the three middle or intermediate speakers, the center speaker would generate sound which would be substantially monaural in nature, since, by mixing the signals in the mixer as described above, it would include 50% of its amplitude from signals emanating from the left channel and 50% of its amplitude from signals emanating from said right channel. The speaker between the leftmost speaker and the center speaker would have the following ammplitude portion from said left and right channels. Since this intermediate speaker has three channels to its right with respect to the listener, i.e. two intermediate channels and a right channel, and since there are five speakers in the system, the amplitude portion from said left channel would be equal to three divided by five minus one or 75%. Similarly, since there is only one speaker to said intermediate channel's left the amplitude portion from said right channel would be one divided by four or 25%. The amplitude portions for the intermediate speaker positioned between the center speaker and the right channel would be equivalent, with 75% of its signal coming from the right channel and 25% from the left channel. Consequently, as can be seen, the signals from all five speakers provide sound reproduction that is much more evenly spaced and therefore more realistic than with having merely two output channels.

The preferred embodiment of a mixer according to the present invention is a voltage dividing network, as shown at 20 in FIG. 1. The network includes a first resistor 70, a second resistor 72 and a third resistor 74. All resistors 70, 72 and 74 for each mixer are of a high enough impedance such that the load created thereby on the audio output lines from the left and the right channels is relatively insignificant with respect to the load of the leftmost speaker 14 and the rightmost speaker 18. That is, for a speaker of eight ohms, a resistance of 1500 to 3000 ohms for each of the resistors in a given mixer would be sufficient to provide this non-loading function.

The resistor 70 in combination with resistor 74 acts as an attenuator for the audio output signal output by the right audio channel R. Similarly, the resistor 72 in combination with resistor 74 acts as an attenuator for the signal output by the left audio channel L. The interaction of resistor 70 and 72 with resistor 74 creates the voltage division desired to provide an output signal which is the desired sum of the signals input thereto. For example, in the six channel output system shown in FIG. 1, for speaker 42 we would desire 80% of the signal from the R channel and 20% of the signal from the L channel to be output thereby. Thus, resistor 70 would be selected to be 1600 ohms, resistor 72 to be 400 ohms and resistor 74 to be 300 ohms. Note that since these resistors attenuate the L and R channel signals, the amplifier to which this signal is coupled, amplifies the signal such that the amplitude portion contributed from said R channel is 80% of the actual amplitude of the signal output by said R channel. Similarly, the amplifier amplifies the signal such that the amplitude portion contributed by said L channel is 20% of the amplitude of the signal output by said L channel. Thus the sum of these two amplitude portions has the same relative amplitude as the outputs of said L and R channels.

Note that each intermediate channel may also include a variable resistor between a given mixer and amplifier means. As shown in FIG. 1, these variable resistors 80, 82, 84 and 86 may be added to provide means for adjusting the amplification of said amplifier means and thus the amplitude of the signals as output by each channel. Note also that it is important that the amplitude of the intermediate channel output signals not be greater than the output of the signals emanating from the leftmost speaker 14 and the rightmost speaker 18. This is so that there is not an overriding effect of the monaural components over the stereophonic components of the resultant sound. That is, the contribution of the left and right stero signals to a given intermediate channel becomes more equal as the midpoint between the leftmost speaker and rightmost speaker is approached, with a center speaker having effectively a 100% monaural output, i.e. 50% of its signal supplied from the left channel and 50% supplied from the right channel.

Figure 2:
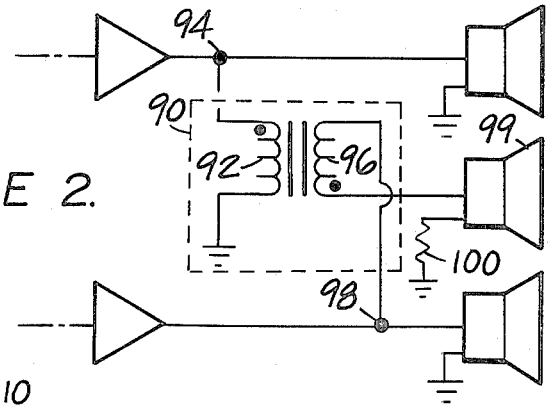
FIG. 2 illustrates an alternate embodiment of the present invention wherein a midpoint audio channel is derived from a transformer mixer.

FIG. 2 illustrates an alternate embodiment of the present invention, wherein the mixing means for a center speaker would be obtained from a transformer rather than from a resistive mixer. The advantage of such a system would be the elimination of the need for an additional amplifier. As seen in FIG. 2, the transformer mixer 90 would have one of its windings 92 connected to the next adjacent rightmost intermediate channel 94. Similarly, the transformer mixer 90 would have its other windings 96 connected to the next adjacent intermediate channel 98 on the opposite side. The winding 96 is also connected at its opposite end to the midpoint speaker 99 for output of the center channel sound thereby. Note that the outputs from intermediate channel 94 and 98 are connected to windings 92, 96 in such a way that the output to speaker 99 is an additive sum of these two signals. The resistance 100 is provided as an attenuator of 8 ohms for reducing the amplitude of the signal output by speaker 99 such that it is substantially equal to the amplitude of the signal output by the other speakers in the reproduction system.

Figure 3:
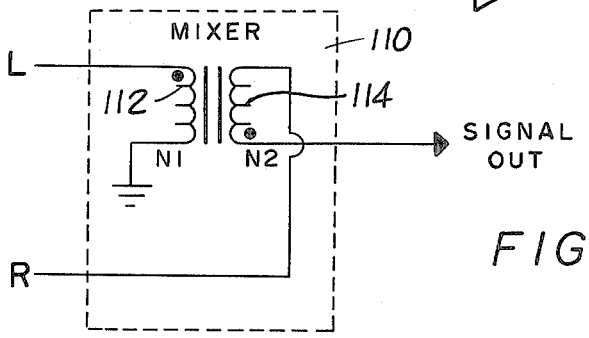
FIG. 3 illustrates an alternate embodiment of a mixer according to the present invention.

FIG. 3 illustrates an alternate embodiment of a mixer according to the present invention. The mixer in this embodiment is a transformer mixer 110 including first and second windings 112 and 114 are shown. To obtain the desired mixing of a normally unequal fractional amount of each said left and right channel signals, the number of turns of winding 112 is defined to be a number N1 different from the number of turns N2 of winding 114, such that the output produced from mixer 110 is the sum of the desired fractional amount of both said left and right channel signals.

It is to be understood that the foregoing description is merely illustrative of a preferred embodiment of the invention and that the scope of the invention is not to be limited thereto but is to be determined by the scope of the appended claims.

I claim:

1. A method for generating at least four audio output channels from first and second stereophonically related audio output signals, said output channels including a leftmost output channel, a rightmost output channel, and at least two intermediate output channels, wherein each output channel is coupled to a separate one of a plurality of speakers arranged in an ordered series such that all said speakers are in a position in front of a listener, and including with respect to said listener a leftmost speaker for audio output of said leftmost channel, a rightmost speaker for audio output of said rightmost channel, and at least two intermediate speakers positioned between said leftmost and said rightmost speakers for audio output of said intermediate channels, comprising the steps of:

(a) coupling said first stereophonically related signal directly out as the leftmost audio output channel to said leftmost speaker;

(b) coupling said second stereophonically related signal directly out as the rightmost audio output channel to said rightmost speaker;

(c) transferring from said first signal a predetermined amplitude portion to each said intermediate channel, the amplitude of each said amplitude portion being defined to be a lesser amount as a function of the distance that the corresponding intermediate channel is away from said leftmost speaker and nearer to said rightmost speaker;

(d) transferring from said second signal a predetermined amplitude portion to each said intermediate channel, the amplitude of said amplitude portion being defined to be a lesser amount as a function of the distance that the corresponding intermediate channel is away from said rightmost speaker and nearer to said leftmost speaker to the same extent that said amplitude portion from said first signal is lessened in amplitude in the opposite direction from said leftmost speaker, such that at substantially the midpoint between said leftmost speaker and said rightmost speaker, the amplitude portion contributed by each said first and second signal is substantially equal;

(e) additively combining into one signal, in each said intermediate channel, the predetermined amplitude portion of said first and second signal transferred thereto; and (f) equalizing said combined signal in each said intermediate channel such that the signal amplitude output from each said intermediate channel coupled to its respective speaker is of the same relative amplitude as the signal amplitude output from said leftmost audio channel and said rightmost audio channel.

2. The method of claim 1 wherein step (c) further comprises the step of transferring from said first signal a predetermined amplitude portion to each said intermediate channel, wherein the amplitude of said amplitude portion for a given intermediate channel is equal to a fractional amount of the total signal transferred to said intermediate channel of an amount equal to the number of speakers positioned to the right of said intermediate speaker divided by the total number of speakers in said ordered series less one.

3. The method of claim 1 wherein step (d) further comprises the step of transferring from said second signal a predetermined amplitude portion to each said intermediate channel, wherein the amplitude of said amplitude portion for a given intermediate channel is a fractional amount of the total signal transferred to said intermediate channel of an amount equal to the number of speakers positioned to the left of said intermediate channel divided by the total number of speakers in said ordered series less one.

4. The method of claim 1 wherein step (f) comprises the step of amplifying said combined signal in each said intermediate channel.

5. An apparatus for generating at least four audio output channels from first and second stereophonically related audio signals, said output channels including a leftmost channel, a rightmost channel, and at least two intermediate channels, said apparatus comprising:

A plurality of speakers, each said audio output channel being operatively connected to one of said speakers, said speakers being oriented in an ordered series in front of a listener such that the leftmost speaker, for output of said leftmost channel, is at the listener's left; the rightmost speaker, for output of said rightmost channel, is at the listener's right; and each intermediate speaker, for output of each said intermediate channel, is positioned therebetween, with half on one side of a midpoint between said leftmost and rightmost speakers and half on the opposite side;

means for coupling said first signal out as said leftmost output channel;

means for coupling said second signal out as said rightmost output channel; and means in each said intermediate channel for coupling a portion of each said first and second signals out as said intermediate output channels including:

(i) means for mixing a predetermined amplitude portion of said first audio signal with a predetermined amplitude portion of said second audio signal said means comprising:

means for coupling a lesser amplitude portion from said first signal to each said intermediate channel, the amplitude thereof being a function of the distance that the corresponding intermediate speaker is away from said leftmost speaker and nearer to said rightmost speaker; and means for coupling a lesser amplitude portion from said second signal to each said intermediate channel, the amplitude thereof being a function of the distance that the corresponding intermediate speaker is away from said rightmost speaker and nearer to said leftmost speaker to the same extent that said amplitude portion from said first signal is lessened in amplitude in the opposite direction from said leftmost speaker; and (ii) equalizer means, for equalizing the relative amplitudes of said mixed signals, such that the output from each intermediate channel is of substantially the same relative amplitude as the output of said first and second signals as output by said leftmost channe and said rightmost channel.

6. An apparatus for generating a plurality of audio output channels from first and second stereophonically related audio signals, said output channels including a leftmost channel, a rightmost channel, and one or more intermediate channels, said apparatus comprising:

a plurality of speakers, each said audio output channel being operatively connected to one of said speakers, said speakers being oriented in an ordered series in front of a listener such that the leftmost speaker, for output of said leftmost channel, is at the listener's left; the rightmost speaker, for output of said rightmost channel, is at the listener's right; and each intermediate speaker is positioned therebetween, with half on one side of a midpoint between said leftmost and rightmost spekers and half on the opposite side;

means for coupling said first signal out as said leftmost output channel;

means for coupling said second signal out as said rightmost output channel;

means in each said intermediate channel for coupling a portion of each said first and second signals out as said intermediate output channels including:

(i) means for mixing a predetermined amplitude portion of said first audio signal with a predetermined amplitude portion of said second audio signal, including: means for coupling a lesser amplitude portion from said first signal to each said intermediate channel, the amplitude thereof being a function of the distance that the corresponding intermediate speaker is away from said leftmost speaker and nearer to said rightmost speaker; and means for coupling a lesser amplitude from said second signal to each said intermediate channel, the amplitude thereof being a function of the distance that the corresponding intermediate speaker is away from said rightmost speaker and nearer to said leftmost speaker to the same extent that said amplitude portion from said first signal is lessened in amplitude in the opposite direction from said leftmost speaker; and (ii) equalizer means, for equalizing the relative amplitudes of said mixed signals, such that the output from each intermediate channel is of substantially the same relative amplitude as the output of said first and second signals as output by said leftmost channel and said rightmost channel; and means for generating a center audio output channel for output to a mid-speaker positioned at said midpoint, said means comprising:

transformer means, including first and second windings;

means for coupling the output of the intermediate output channel, operatively positioned adjacent to said midpoint on the left with respect to said listener, to said first winding of said transformer means;

means for coupling the output of the intermediate output channel, operatively positioned adjacent to said midpoint on the right with respect to said listener, to said second winding of said transformer means; and means for coupling the audio output of said transformer means to said mid-speaker, and including attenuator means such that the amplitude of the audio output of said mid-speaker is substantially the same as the amplitude of respective audio signals output by said adjacent intermediate channels.

7. The apparatus of claim 5 wherein said means for mixing for each said intermediate channel comprises a voltage dividing network including:

a first resistive element operatively connected in series between said first audio signal and the input to said amplifier means;

a second resistive element operatively connected in series between said second audio signal and the input to said amplifier means; and a third resistive element connected between said amplifier means input and system ground.

8. An apparatus for generating a plurality of audio output channels from first and second stereophonically related audio signals, said output channels including a leftmost channel, a rightmost channel, and one or more intermediate channels, said apparatus comprising:

a plurality of speakers, each said audio output channel being operatively connected to one of said speakers, said speakers being oriented in an ordered series in front of a listener such that the leftmost speaker, for output of said leftmost channel, is at the listener's left; the rightmost speaker, for output of said rightmost channel, is at the listener's right; and each intermediate speaker is positioned therebetween, with half on one side of a midpoint between said leftmost and rightmost speakers and half on the opposite side;

means for coupling said first signal out as said leftmost output channel;

means for coupling said second signal out as said rightmost output channel;

means in each said intermediate channel for coupling a portion of each said first and second signals out as said intermediate output channels including:

(i) means for mixing a predetermined amplitude portion of said first audio signal with a predetermined amplitude portion of said second audio signal, including: means for coupling a lesser amplitude portion from said first signal to each said intermediate channel, the amplitude thereof being a function of the distance that the corresponding intermediate speaker is away from said leftmost speaker and nearer to said rightmost speaker; and means for coupling a lesser amplitude portion from said second signal to each said intermediate channel, the amplitude thereof being a function of the distance that the corresponding intermediate speaker is away from said rightmost speaker and nearer to said leftmost speaker to the same extent that said amplitude portion from said first signal is lessened in amplitude in the opposite direction from said leftmost speaker, said means for mixing each said predetermined amplitude portion comprising transformer means including:

a first winding including a first plurality of turns;

a second winding including a second plurality of turns;

means for coupling said first signal to said first winding; and means for coupling said second signal to said second winding; and (ii) equalizer means, for equalizing the relative amplitudes of each said mixed signal, such that the output from each intermediate channel is of substantially the same relative amplitude as the output of said first and second signals as output by said leftmost channel and said rightmost channel.

9. The apparatus of claim 5 wherein said equalizer means comprises for each said intermediate channel, an amplifier for amplifying said mixed signal a predetermined amount, such that the output of said intermediate channel is of the same relative amplitude as the signals output by said leftmost channel and said rightmost channel.

* * * * *